United States Patent [19]

Morinaga

[11] 4,391,024

[45] Jul. 5, 1983

[54] BUCKLE DEVICE

[75] Inventor: Masaru Morinaga, Yamato, Japan

[73] Assignee: NSK-Warner K.K., Tokyo, Japan

[21] Appl. No.: 247,148

[22] Filed: Mar. 24, 1981

[30] Foreign Application Priority Data

Apr. 10, 1980 [JP] Japan ..... 55-47613[U]

[51] Int. Cl.[3] ..... A44B 11/25

[52] U.S. Cl. ..... 24/230 A

[58] Field of Search ..... 24/230 A, 230 AL

[56] References Cited

U.S. PATENT DOCUMENTS 3,895,196 2/1975 Lewis ..... 200/61.58 B 4,136,425 1/1979 Esner ..... 24/230 A 4,237,586 12/1980 Morinaga ..... 24/230 A

*Primary Examiner*—Hugh R. Chamblee

*Attorney, Agent, or Firm*—Shapiro and Shapiro

[57] ABSTRACT

A buckle device has a tongue, a base, a latch member supported on the base and movable between an engaged position with the tongue and a non-engaged position with the tongue, a push button for releasing the engagement between the tongue and the latch member when manually operated, and a lever member pivotably supported on the base and having a spring portion integrally formed therewith. Biasing of the latch member in a tongue engaging direction by the spring portion and disengagement between the latch member and the tongue by the push button are accomplished through the lever member.

8 Claims, 5 Drawing Figures

BUCKLE DEVICE

BACKGROUND OF THE INVENTION

1. Field of the Invention

This invention relates to a buckle device.

2. Description of the Prior Art

Numerous types of buckle devices have heretofore been proposed. However, most of them leave room for improvement in ease of assembly, number of parts and disengagement operation.

SUMMARY OF THE INVENTION

It is an object of the present invention to solve such problems and to provide a buckle device having a pivotable lever member with a spring portion which is loosely engaged with a latch member and wherein biasing of the latch member in a tongue engaging direction by the spring portion and disengagement between the latch member and the tongue by a push button member are accomplished through the lever member.

The invention will become fully apparent from the following detailed description thereo ' 'aken in conjunction with the accompanying drawings.

DESCRIPTION OF THE PREFERRED EMBODIMENTS

Figure 1:
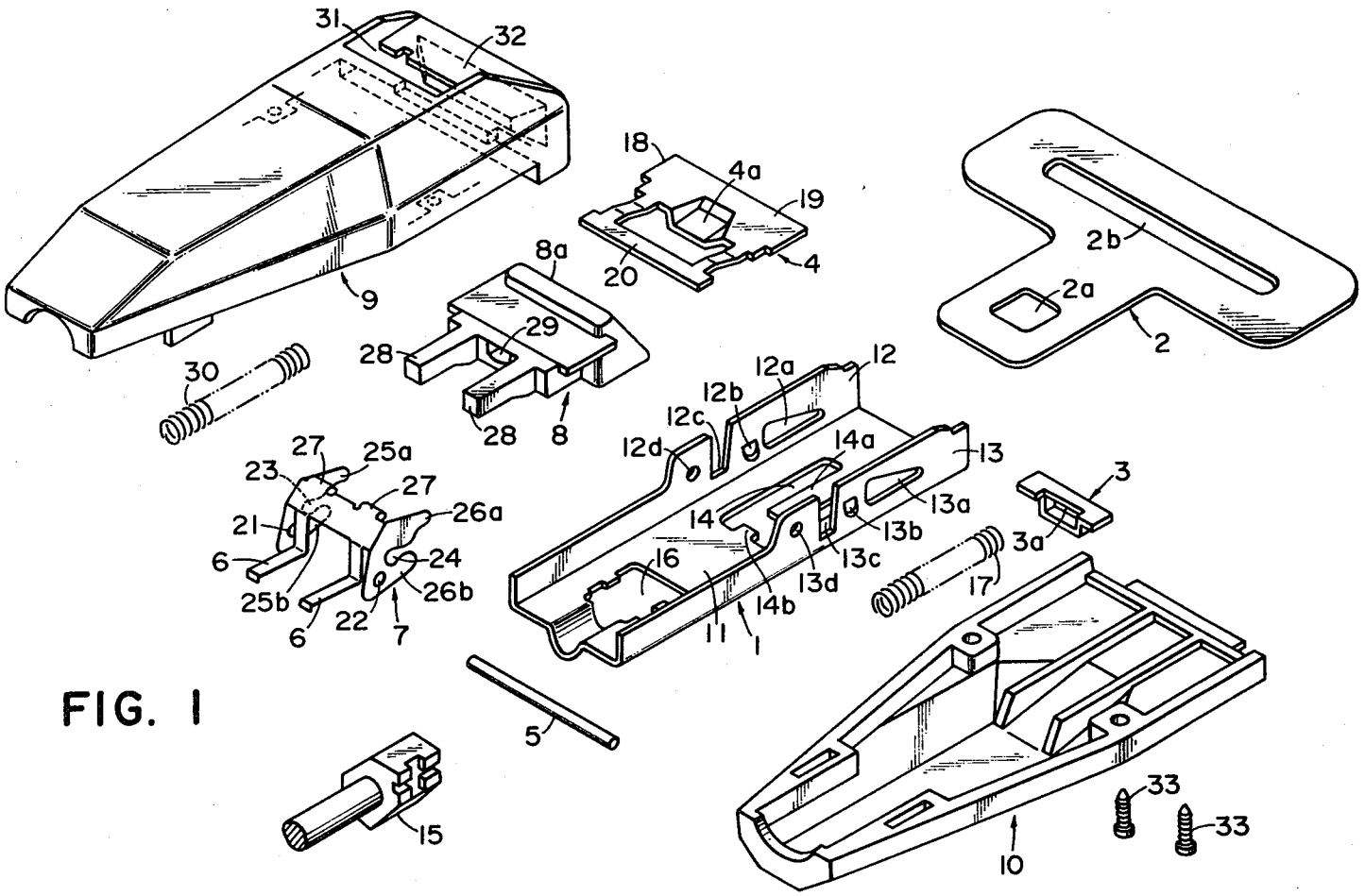
FIG. 1 is an exploded perspective view of a first embodiment of the present invention.

A first embodiment of the buckle device shown in FIG. 1 has a base 1, a slider 3 slidable along the lengthwise direction of the base 1 for springing-out a tongue 2 when disengaged and prevention of false locking (engagement supposed to have been established between the tongue 2 and a latch member 4 to be described, although actually complete engagement is not established therebetween) during insertion of the tongue, a latch member 4 mounted on the base 1 for pivotal movement generally about the fore end portion thereof, a lever member 7 provided for pivotal movement about a rod 5 attached to the base 1 and having spring portions 6, a slide type push button 8 as disengagement means, and upper and lower covers 9 and 10.

The base 1 comprises a flat portion 11 and side plate portions 12, 13 substantially vertically rising from the opposite side edges of the flat portion 11. The flat portion 11 is formed with a generally H-shaped hole 14 in the fore end portion thereof (that end from which the tongue 2 enters is the fore end) and a hole 16 for receiving therein the end portion of a positioning member 15 of the buckle device. A long projected portion **14*a* and a short projected portion 14*b* projected in opposed relationship with each other are formed in the H-shaped hole 14, and the slider 3 having through-hole 3*a* therein is fitted on the long projected portion 14*a*. The slider 3 is forwardly biased by a coil spring 17 having one end loosely fitted around the long projected portion 14*a* and received on the rear end surface of the slider 3 and the other end loosely fitted around the short projected portion 14*b*. The hole 16 is formed with a concave portion and a convex portion on the opposite sides thereof and, when the end portion of the member 15 is forced into the hole 16, the concave and the convex portions suitably engage the groove at the end of the member 15, whereby the member 15 is connected to the base 1**.

In the side plate portions 12 and 13 of the base 1, there are formed, in opposed relationship, sector holes **12*a* and 13*a* for receiving therein ears 18 and 19 of the fore end portion of the latch member 4, embossed portions 12*b* and 13*b* for preventing the tongue 2, when inserted, from floating from the flat portion 11, upwardly opening cut-aways 12*c* and 13*c* permitting the opposite ends of bridge portion 20 of the rear end of the latch member 4 to extend outwardly through the side plate portions 12 and 13 and thereby guiding the opposite ends of the bridge portion 20, and circular holes 12*d* and 13*d* for supporting the rod 5**.

The latch member 4 further has a downwardly projected latch portion **4*a* in the intermediate portion thereof and this latch portion 4*a* engages the square hole 2*a* of the tongue 2** to lock the latter.

The lever member 7 is formed integrally with the spring portions 6 and of a resilient material, and has, in addition to the pair of spring portions 6 each extending rearwardly in an L-shape, circular holes 21 and 22 through which the rod 5 is passed, a pair of first arms **25*a*, 26*a* and a pair of second arms 25*b*, 26*b* defining a pair of recess portions 23, 24 loosely engaging the opposite end portions of the bridge portion 20 of the latch member 4, and an engaging portion 27 for engaging the push button 8. By the lever member 7 being disposed with the spring portions 6 urged against the flat portion 11, the lever member 7 is biased clockwise about the rod 5 as viewed in FIG. 1. The purpose of the cut-aways 12*c* and 13*c* provided in the side plate portions 12 and 13 and the bridge 20 of the latch member 4 which extends outwardly of these cut-aways is to provide the bridge portion 20 from being disengaged from the recess portions 23 and 24 of the lever member 7 even when the first and second arms are more or less opened outwardly by a degree of force exerted on the lever member 7. The push button 8 is slidable along the lengthwise direction of the base 1 by being guided by the upper end surfaces of the side plate portions 12 and 13, and has a manually operated surface 8*a* in the fore end thereof, a pair of rearward extensions 28 in the rear end thereof and a cylindrical recess 29 therebetween. The extensions 28 are for bearing against the engaging portions 27 of the lever member 7 when the push button 8 slides rearwardly, to thereby rotate the lever member 7 counterclockwise against the biasing force of the spring portions 6, and the recess 29 is for receiving one end of a coil spring 30 therein. The other end of the coil spring 30 is installed on a lateral wall 9*a* (see FIG. 2) projected from the inner surface of the upper cover 9, and the coil spring 30 normally biases the push button 8** forwardly.

The foremost upper portion of the upper cover 9 provides an opening 31 for exposing the manually operated surface **8*a* of the push button 8 and, below this opening 31, there is formed an opening 32 through which the tongue may be inserted. The upper cover 9 further has a portion into which the fore end portion of the base 1 is fitted, and portions for meshing or abutting with the corresponding portions of the lower cover 10, and they are coupled together by screws 33**.

The tongue 2 has, in addition to the locking square hole 2*a*, a slot 2*b* through which webbing is inserted and secured.

Operation of the first embodiment having the above-described construction will now be described.

Figure 2:
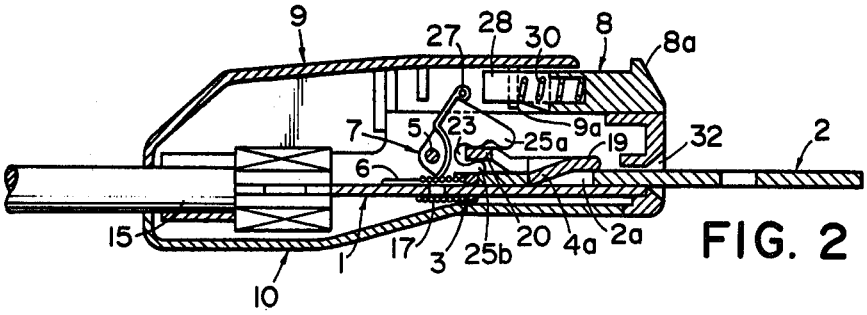
FIGS. 2 and 3 are partial longitudinal cross-sectional views illustrating the operation of the first embodiment.

FIG. 2 is a partial longitudinal cross-sectional view showing a condition in which the tongue 2 has been inserted through the opening 32 and meshes with the latch member 4. At this time, the latch member at its bridge portion 20 is engaged with the first arms 25*a* and 26*a* of the lever member 7 and is biased counterclockwise as viewed in FIG. 2 into a meshing position. In this condition, the fore end surfaces of the ears 18 and 19 of the latch member 4 which bear against the fore edge portions of the sector holes 12*a* and 13*a* in the side plate portions 12 and 13 of the base 1 lie above the latch portion 4*a* of the latch member 4 meshing with the square hole 2*a* of the tongue 2 and therefore, even if one tries to withdraw the tongue 2, the latch member 4 tends to be moved toward a deeper meshing position. Thus, the locked condition is not released. Also, in this condition, the slider 3 has been slidden rearwardly and a restitutional force is stored in the coil spring 17.

Figure 3:
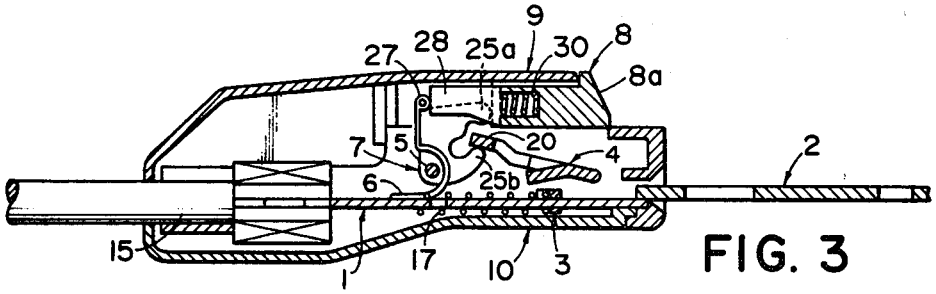

Hereupon, a force is applied to the surface 8*a* of the push button 8 as by a finger to slide the push button rearwardly against the biasing force of the coil spring 30. Then, the rear end surfaces of the extensions 28 of the push button 8 come to bear against the engaging portions 27 of the lever member 7, thereby imparting to the engaging portions a counter-clockwise torque about the rod 5 as viewed in FIG. 3. Accordingly, the lever member 7 begins to rotate counterclockwise against the biasing force of the spring portions 6 and, at the second arms 25*b* and 26*b*, the lever member 7 comes into engagement with the bridge portion 20 of the latch member 4, whereupon the lever member raises the latch member 4 from its meshing position. In this manner, the meshing engagement between the tongue 2 and the latch member 4 is released and at the same time, the tongue 2 is ejected by the slider 3 and the coil spring 17 which has stored therein a restitutional force. This state is shown in FIG. 3.

When the force applied to the push button 8 is released, the push button 8 returns to its original position with the aid of the coil spring 30 and the lever member 7 also returns to its original position in accordance with the force of the spring portions 6, and the slider 3 remains in its sprung out position until the tongue 2 is inserted the next time, thereby maintaining the latch member 4 in a somewhat upwardly floating position and facilitating the next insertion of the tongue as well as preventing the false locking.

Description will now be made of a second embodiment in which the spring for biasing the push button is integrally formed with the lever member and correspondingly the push button is somewhat modified.

Figure 4:
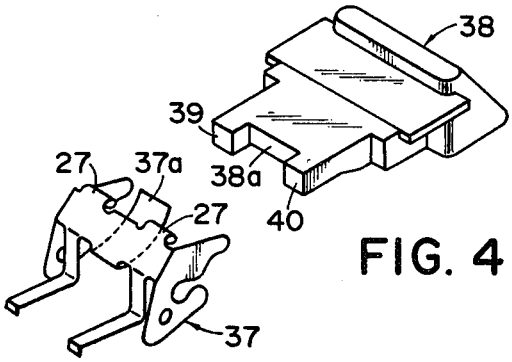
FIG. 4 is an exploded perspective view of some parts of a second embodiment of the present invention.

In the second embodiment, as shown in FIG. 4, a spring portion 37*a* of push button extends obliquely upwardly in the central portion of a lever member 37 and corresponds to said coil spring 30 of the first embodiment push button 38 does not have the extensions 28 and the recess 29 of the first embodiment, but instead has a central rear surface 38*a* which is always in contact with the spring portion 37*a*.

Figure 5:
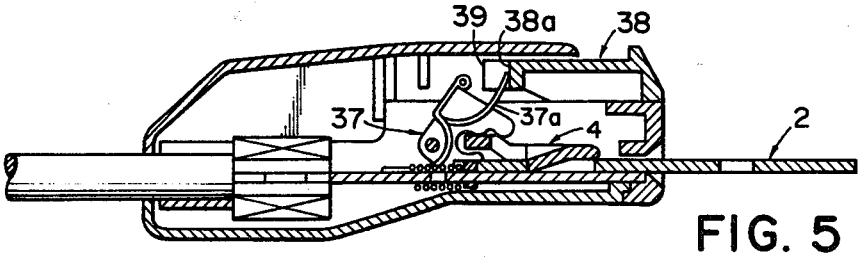
FIG. 5 is a partial longitudinal cross-sectional view illustrating the operation of the second embodiment.

The present embodiment is almost similar in operation to the first embodiment, but describing somewhat supplementally, when the push button 38 is slidden rearwardly, the rear surfaces 39 and 40 on the opposite sides thereof slightly projected from the central rear surface 38*a* bear against the engaging portions 27 of the lever member 37 and therefore the lever member 37 begins to rotate counterclockwise as viewed in FIG. 5.

Now, in the foregoing two embodiments, the length from the rod 5 to the point of engagement between the engaging portions 27 of the lever member and the push button is greater than the length from the rod 5 to the point of engagement between the bridge portion 20 of the latch member 4 and the second arms 25*b*, 26*b* of the lever member, and this makes the disengagement operation of the latch member smoother by the lever action.

According to the present invention, as has been described above, the construction in which operation of the latch member is accomplished through the lever member having an integral spring portion leads to the possibility of providing a buckle device which is excellent in ease of assembly and disengagement operation property.

I claim:

1. A buckle device for latching to a tongue, comprising a base, a latch member supported on said base so as to be movable between an engaged position with said tongue and a non-engaged position with said tongue, a push button member for releasing the engagement between said tongue and said latch member when manually operated, and a lever member pivotally supported on said base and having a first portion adapted to be engaged by said push button member when the push button member is manually operated, a second portion adapted to engage said latch member so as to bring said latch member into said engaged position and to hold said latch member in such position, a third portion adapted to engage said latch member when said push button member is manually operated to bring said latch member from said engaged position into said non-engaged position, the latch member being held loosely between said second and third portions, and a spring portion for imparting a biasing force to the lever member in a direction in which said second portion is engaged with said latch member, said lever member being adapted, when said push button member is operated with said tongue and said latch member being engaged with each other, to receive a rotational force applied to said first portion and to transmit said rotational force to said latch member through said third portion to thereby bring said latch member from said engaged position into said non-engaged position.

2. A buckle device according to claim 1, wherein said lever member is unitarily formed of a resilient material.

3. A buckle device according to claim 1, wherein said spring portion of said lever member is an L-shaped portion extending rearwardly and bearing against said base.

4. A buckle device according to claim 1, wherein the distance from the rotation center of said lever member to the point of engagement of said first portion is longer than that from said rotation center to the point of engagement of said third portion.

5. A buckle device according to claim 1, further comprising biasing means provided on said base for biasing means biases said tongue outwardly when said latch member engages said tongue and for ejecting said tongue when the engagement between said latch member and said tongue is released by manually operating said push button member.

6. A buckle device according to claim 1, wherein said lever member is formed with another spring portion for biasing the push button member to a non-operated position.

7. A buckle device according to claim 1, wherein said latch member has a fore end portion pivotally supported on said base, an intermediate portion adapted to be engaged by said tongue, and a rear end portion loosely held between said second portion and said third portion of said lever member.

8. A buckle device according to claim 7, wherein said base has a flat portion and a pair of side plate portions rising substantially vertically from the opposite side edges of said flat portion, and said side plate portions are formed with a pair of opposed sector holes receiving therein opposite side portions of the fore end portion of said latch member, and a pair of opposed upwardly opening cut-aways for guiding the opposite side portions of the rear end portion of said latch member.

* * * * *